United States Patent [19]

Babb

[11] 4,297,537

[45] Oct. 27, 1981

[54] DYNAMIC LOUDSPEAKER

[76] Inventor: Burton A. Babb, 6618 Briarhaven, Dallas, Tex. 75240

[21] Appl. No.: 58,105

[22] Filed: Jul. 16, 1979

[51] Int. Cl.[3] ..... H04R 7/26

[52] U.S. Cl. ..... 179/180; 179/115.5 VC

[58] Field of Search ..... 179/180, 184, 115.5 VC, 179/115.5 R, 119 R; 181/166

[56] References Cited

U.S. PATENT DOCUMENTS

| | | | |
|---|---|---|---|
| 1,715,057 | 5/1929 | Decaux | 179/115.5 VC |
| 2,164,374 | 7/1939 | Barker | 179/115.5 VC |
| 2,775,653 | 12/1956 | Wurdel | 179/115.5 VC |
| 3,358,088 | 12/1967 | Gault | 179/115.5 VC |
| 3,496,307 | 2/1970 | Sotome | 179/180 X |
| 3,983,337 | 9/1976 | Babb | 179/115.5 R |
| 4,115,667 | 9/1978 | Babb | 179/115.5 VC |

FOREIGN PATENT DOCUMENTS

| | | | |
|---|---|---|---|
| 2511226 | 9/1976 | Fed. Rep. of Germany | 179/115.5 R |

*Primary Examiner*—Thomas W. Brown

*Attorney, Agent, or Firm*—Thomas L. Cantrell; Joseph H. Schley; Stanley R. Moore

[57] ABSTRACT

Improvements are disclosed in a loudspeaker of the type having a speaker cone assembly which is reciprocated by a current-carrying voice coil suspended in a constant magnetic field. The constant magnetic field is generated in an annular flux gap formed by a magnetic assembly which includes a cylindrical center pole and an outer pole defining the annular flux gap therebetween. An antifriction bearing which adjoins the voice coil and slidably moves on the cylindrical center pole provides an essentially infinite compliance rear suspension for the speaker cone assembly. The principal improvement of the disclosed loudspeaker is characterized by shock absorbing bumpers which confine the excursions of the speaker cone assembly within a defined range with minimum noise generation and without reducing the compliance of the rear suspension.

5 Claims, 3 Drawing Figures

DYNAMIC LOUDSPEAKER

The present invention generally pertains to loudspeakers, and more particularly to an improved dynamic loudspeaker of the type described in my U.S. Pat. No. 4,115,667, the terms of which are hereby incorporated by reference.

Briefly, the loudspeaker described in U.S. Pat. No. 4,115,667 includes a magnetic assembly and an acoustic radiating assembly (or moving cone-coil assembly) supported by a suitable frame. The magnetic assembly includes a permanent magnet having magnetic poles on its opposed major surfaces at which are disposed front and back pole plates, all of which are generally toroidal in shape. The magnetic assembly further includes a cylindrical center pole affixed to the back pole plate and extending inwardly through the magnet and front pole plate to form an annular flux gap between the adjacent surfaces of the center pole and front pole plate. The acoustic radiating assembly includes a voice coil which is radially suspended and axially guided in the annular flux gap by an adjoining antifriction bearing member which in turn is disposed in continuous sliding contact with the cylindrical surface of the center pole. The acoustic radiating assembly further includes a cylinder which extends forward from the voice coil to drive a speaker cone to produce acoustic energy in a manner more fully described in my aforementioned patent. The periphery of the speaker cone is radially suspended from the frame by a flexible rolled edge seal which freely allows axial movement of the speaker cone. The rolled edge seal is an essentially conventional type of front suspension for the speaker cone assembly. However, the antifriction bearing member is a unique type of rear suspension system which is described and claimed in my aforementioned patent.

The rear suspension provided by the antifriction bearing member sliding on the center pole is essentially infinite in compliance. I have found that such highly compliant rear suspension has a tendency, if the voice coil is overdriven beyond rating by low frequency signals, to permit excessive excursions of the voice coil from its quiescent center point in the annular flux gap. An excessive excursion of the voice coil in the forward direction can cause the bearing member to move beyond the forward end of the center pole and become misaligned with the center pole, thereby preventing the return rearward movement of the acoustic radiating assembly in the normal manner. An excessive excursion of the voice coil in the rearward direction can cause the bearing member to collide with the back pole plate, thereby permanently damaging or destroying the bearing member. The acoustic radiating assembly can be designed to collide with the center pole before the bearing member can meet the back pole plate, but such an arrangement has been found to cause noticeable displeasing noise in the sound reproduction of the speaker.

It is a principal object of the present invention to overcome the aforementioned problems caused by excessive excursions of the acoustic radiator assembly when the voice coil is overdriven.

More particularly, it is an object of the present invention to provide an improved dynamic loudspeaker having an essentially infinite compliance rear suspension system for reciprocation of an acoustic radiator assembly within a defined range, wherein excursions of the acoustic radiator assembly beyond the defined range are quietly damped without damaging the loudspeaker.

In accordance with a specific object of the present invention, first and second shock absorbing bumpers are appropriately disposed in the loudspeaker for receiving the impact of the acoustic radiator assembly to limit the respective forward and rearward movements thereof whenever the voice coil is overdriven.

Additional advantages and novel features of the present invention may be best understood by reference to the accompanying drawings, wherein.

Figure 2:
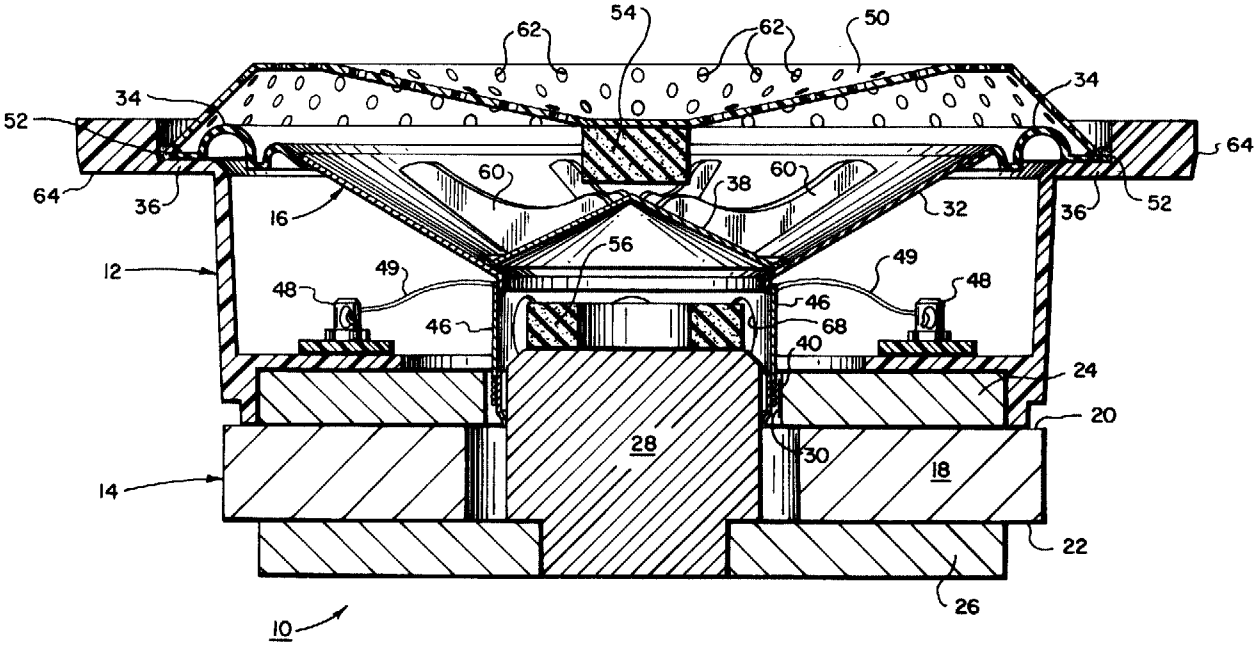
FIG. 2 is a vertical cross-section taken through the center of the inventive loudspeaker wherein certain background features have not been shown for sake of clarity and ease of illustration.

Referring now to the drawings, wherein like reference numerals designate like parts in each of the figures, a presently preferred loudspeaker in accordance with the invention is designated generally by reference numeral 10. With particular reference to FIG. 2, the loudspeaker 10 includes a frame or basket 12, a magnetic assembly 14 supported rearwardly by the frame 12, and an acoustic radiator assembly or speaker cone assembly 16 supported forwardly by the frame 12.

The magnetic assembly 14 comprises a generally toroidal shaped permanent magnet 18 having opposed major surfaces 20 and 22 defining magnetic poles of opposite polarity. The magnetic assembly 14 further includes a generally toroidal shaped front pole plate or outer pole 24 adhesively secured to surface 20 of the magnet 18, a generally toroidal shaped back pole plate 26 adhesively secured to surface 22 of the magnet 18, and a cylindrical center pole 28 affixed to the back pole plate 26 and extending forwardly through the magnet 18 and front pole plate 24. It will be appreciated that an annular flux gap 30 is formed between the adjacent surfaces of the front pole plate 24 and the cylindrical center pole 28. A suitable adhesive for securing the various members of the magnetic assembly 14 to each other is cyanoacrylate. The front pole plate 24 can also be adhesively secured to the frame 12 but is preferably insert molded into the frame 12 using techniques known to those skilled in the art of molding plastics.

Figure 3:
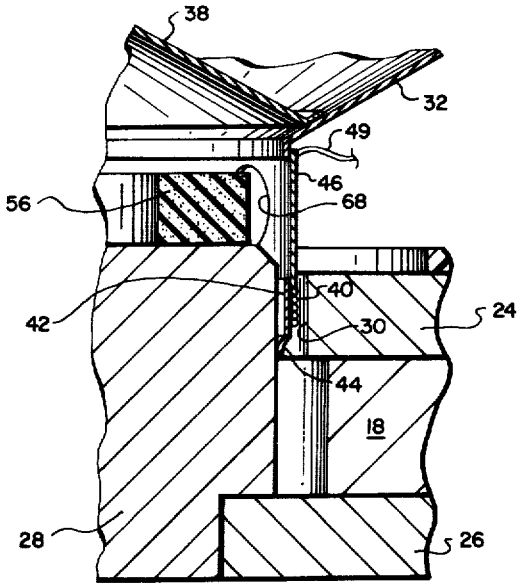
FIG. 3 is an enlarged fragmentary cross-section of a portion of FIG. 2.

The acoustic radiator assembly 16 comprises a speaker cone 32 suspended from its forward periphery by means of a flexible rolled edge seal 34 which is adhesively secured to a recessed shoulder 36 within the forward periphery of the frame 12. A generally conical dust cap 38 is adhesively secured to the center of the speaker cone 32 to isolate the air masses on opposite sides of the speaker cone 32. The speaker cone 32 and dust cap 38 can be fabricated from conventional paper materials. As seen best in FIG. 3, the acoustic radiator assembly 16 further includes a tubular voice coil 40 reciprocally disposed in the annular flux gap 30. The voice coil 40 is wound on a supporting ring 42 of polymeric material, the rearward end of which tapers radially inward to provide a bearing 44 in sliding engagement with the cylindrical surface of the center pole 28. The voice coil 40 and ring 42 are rigidly secured to a thin aluminum cylinder 46 which in turn is secured at its forward end to the speaker cone 32. Electrical connection to the voice coil 40, as illustrated in FIG. 2, is provided by conventional quick-connect terminals 48 and interconnecting leads 49 which have extensions (not shown) along opposite sides of the cylinder 46 to the voice coil 40. The coil 40 and bearing 44 are described in greater detail in my aforementioned patent. However, suffice it to say here that the bearing 44 preferably comprises an antifriction material such as polytetrafluoroethylene (sold under the trademark Teflon). Thus, it will be appreciated that the bearing 44 provides an essentially infinite compliance rear suspension for the acoustic radiator assembly 32. The bearing 44 provides precise radial suspension for the voice coil 40 as it is axially reciprocated in the annular flux gap 30 by the interaction of the constant magnetic field therein with the field produced by electrical signals flowing through the voice coil 40.

A unique system for confining the excursions of the speaker cone 32 within a defined range with minimum noise generation and without reducing the compliance of the rear suspension will now be described with particular reference to FIG. 2. A rigid grille 50 covers substantially the entire front portions of the speaker 10. The grille 50 is secured at its periphery on the recessed shoulder 36 by a suitable adhesive 52. Secured to a central rearward surface of the grille 50 is a first resilient shock-absorbing bumper 54, which preferably comprises a suitable foamed material or fibrous material that is compressible material and has good shock absorbing and acoustic energy absorbing properties. The resilient shockabsorbing bumper 54 is cooperatively disposed to engage the apex of the dust cap 38 whenever the voice coil 40 travels to the forward end of the annular flux gap 30, whereupon the bumper 54 compresses to bring the acoustic radiator assembly 16 to a quiet stop without allowing the bearing 44 to travel beyond the forwardmost edge of the cylindrical surface of the center pole 28. A second resilient shock-absorbing bumper 56 is mounted on the free foward end of the center pole 28 in position to symmetrically engage the conical rear surface of the dust cap 38 whenever the voice coil 40 travels to the rearward end of the annular flux gap 30, whereupon the bumper 56 compresses to bring the acoustic radiator assembly 16 to a quiet stop so that the rearward travel of the bearing 44 will stop short of the back pole plate 26. The second resilient shock-absorbing bumper 56 also preferably comprises a foamed plastic material or fibrous material of the same type as the first resilient shockabsorbing bumper 54. Most preferably, the second bumper 56 is toroidal shaped so that the first and second bumpers 54 and 56 can be conveniently and economically fabricated from the same disk of material wherein the material removed from the center of bumper 56 forms bumper 54. An example of a foamed plastic that provides bumpers 54 and 56 exhibiting superior performance is Scottfelt brand specified as 90 pores/sq. in. with a firmness factor of 5 sold by the Foam Division of Scott Paper Company in Chester, Pennsylvania. Scottfelt foamed plastic has been found to be very effective in quietly damping the peak excursions of the acoustic radiator assembly 16 when the voice coil 40 is overdriven. Scottfelt foamed plastic also has an elasticity such that the bumpers 54 and 56 made from such material return to their pre-impact shape sufficiently slow that the acoustic radiator assembly 16 does not tend to rebound off the bumpers 54 and 56. However, such Scottfelt bumpers 54 and 56 also elastically return to their pre-impact shape fast enough to quietly damp successive impacts by the acoustic radiator assembly 16 in the range of frequencies which tend to produce excessive excursions of the voice coil 40. By contrast, the use of a highly resilient material, such as rubber, for the bumpers 54 and 56 would be comparatively ineffective in absorbing the shock and associated noise of successive impacts by the acoustic radiator assembly 16. Those skilled in the art will appreciate that suitable alternative materials for the bumpers 54 and 56 can be found by experimenting wtih various commerically available sound absorbing polymers.

In the presently preferred embodiment of the invention, the loudspeaker 10 includes a plurality of rigid polystyrene ribs 60 disposed along the dust cap 38 and speaker cone 32 substantially as shown. The ribs 60 add rigidity to the acoustic radiating assembly 16 and increase the high frequency performance of the loudspeaker 10 as described more fully in U.S. Pat. No. 4,115,667. The innermost portions of the ribs 60 are preferably disposed so that they will engage the bumper 54 at about the same time or just before the apex of the dust cap 38 engages the bumper 54, thereby preventing deformation of the dust cap 38 from repeated impacts against the bumper 54.

In accordance with an important feature of the preferred loudspeaker 10, the bumpers 54 and 56 are disposed to receive the impact of the acoustic radiating assembly 16 symmetrically about and as near as practical to the axis of reciprocation. In the case of bumper 54, the apex of the dust cap 38 is disposed directly on the axis of reciprocation and the portions of the ribs 60 that also impact the bumper 54 are disposed symmetrically and proximately about the axis of reciprocation. Likewise, the peripheral forward rim of the bumper 56 is symmetrical about the axis of reciprocation so that a full 360° circle on the conical rear surface of the dust cap 38 will engage the bumper 56.

Figure 1:
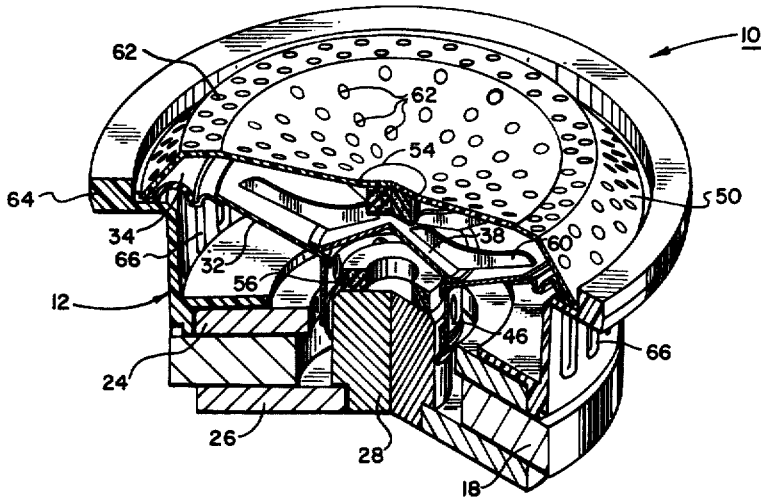
FIG. 1 is a perspective view of a loudspeaker in accordance with the present invention showing a section removed to reveal internal structural features.

Additional details of the preferred loudspeaker 10 can be seen best in FIG. 1. In order to permit the free flow of acoustic energy from the acoustic radiating assembly 16 to the listener, the grille 50 is provided wtih a plurality of openings 62 (only some of which are numbered) which preferably comprise 50% or more of the area of the grille 50.

It will be appreciated that the loudspeaker 10 is intended to be operated in a suitable enclosure (not shown), for which purpose the frame 12 is provided with a peripheral flange 64 adapted to secure the loudspeaker in a circular opening in the enclosure. In order to permit the air mass behind the speaker cone 32 to communicate with air mass inside the enclosure, the rearwardly extending walls of the frame 12 are provided with a plurality of vents or openings 66 as shown in FIG. 1. (Such vents 66 have not been shown in FIG. 2 for ease of illustration.) Those skilled in the art will appreciate that the provision of such vents 66 enhances low frequency sound reproduction by reducing the resistance of the ambient air to wide excursions of the speaker cone 32. With the same considerations in mind, it will be appreciated that the cylinder 46 is preferably provided with a plurality of openings 68 to permit the free flow of air into and out of the confined space between the forward end of the center pole 28 and the dust cap 38.

Finally, although most parts of the loudspeaker 10 have been drawn essentially in proportion in the figures, several dimensions have been intentionally exaggerated for ease of illustration. For example, the thickness dimensions of the various members of the acoustic radiating assembly 16 have been greatly exaggerated. In actual practice, the speaker cone 32, dust cap 38, coil support ring 42, and cylinder 46 are made as thin as possible to minimize the weight of the acoustic radiating assembly 16. In addition, the radial dimension of the annular flux gap 30, which preferably measures 0.048 inch, has been made disproportionately several times larger for better illustration of the voice coil 40 and bearing 44. Further details regarding the preferred voice coil 40 and bearing 44 are disclosed in U.S. Pat. No. 4,115,667.

Although a preferred loudspeaker has been described in detail, it is to be understood that various changes, substitutions and alterations can be made therein without departing from the spirit and scope of the invention as defined by appended claims.

What is claimed is:

1. In a loudspeaker of the kind having a frame, a cylindrical center magnetic pole, an outer magnetic pole disposed around the center pole to form an annular flux gap therebetween, said outer pole and center pole being interconnected at their rear ends by a back pole plate, a speaker cone mounted on said frame in front of said poles for acoustically radiative reciprocation with respect thereto, said cone having an axially disposed dust cap thereon, a tubular voice coil mounted on the back of said cone and positioned in said flux gap, and an antifriction bearing member for said coil disposed in continuous sliding contact with said centerpole, the improvement comprising:

a grille positioned on said frame in front of said speaker cone;

a first bumper formed of resilient material mounted on the back of said grille, said first bumper being positioned and proportioned to lie forwardly of the largest desired forward excursion of said dust cap, said largest desired forward excursion being insufficient to displace said bearing member from said center pole, and to resiliently and quietly stop forward excursions of said dust cap which are larger than said largest desired forward excursion, said first bumper thereby affecting only those forward excursions which are greater than desired; and a second bumper formed of resilient material mounted on the forward end of said center pole, said second bumper being positioned and proportioned to lie rearwardly of the largest desired rearward excursion of said dust cap, said largest desired rearward excursion being insufficient to impact said bearing against said back pole plate, and to resiliently and quietly stop rearward excursions of said dust cap which are larger than said largest desired rearward excursion, said second bumper thereby affecting only those rearward excursions which are greater than desired.

2. The improvement defined in claim 1 in which said first and second bumpers are formed of foamed plastic material, in which said first bumper is generally cylindrical and is axially aligned on the back of said grilled to engage said dust cap symmetrically upon said larger than desired forward excursions, and further in which said second bumper is generally toroidal and is axially aligned on the forward end of said center pole to symmetrically engage the backside of said dust cap upon said larger than desired rearward excursions.

3. The improvement defined in claim 2 in which said first and second bumpers are fabricated from the same disk of material wherein the material removed from the center of the disk forms the first bumper.

4. The improvement defined in claim 2 in which said loudspeaker is of the kind having a generally conical dust cap with its apex oriented to the front, and in which said cylindrical bumper engages the cap upon said larger than desired forward excursions symmetrically at its apex, and further in which said toroidal second bumper engages the conical rear surface of the cap upon said greater than desired rearward excursions.

5. The improvement defined in claim 4 in which said loudspeaker is of the kind having forwardly projecting ribs on said speaker cone, and in which said cylindrical first bumper also engages said ribs symmetrically upon said greater than desired forward excursions.

* * * * *